US005409402A

United States Patent [19]

Ball et al.

[11] Patent Number: 5,409,402

[45] Date of Patent: Apr. 25, 1995

[54] PLUG-IN FUSE DEVICE WITH INTERCHANGEABLE FUSE ELEMENTS

[76] Inventors: Roger M. Ball, 522 Pape Ave., Toronto, Ontario, Canada, M4K 3R4; Steven A. Copeland, 9 Moore Place, Barrie, Ontario, Canada, L4N 6N7

[21] Appl. No.: 237,152

[22] Filed: May 3, 1994

[51] Int. Cl.[6] ..... H01H 85/14

[52] U.S. Cl. ..... 439/621; 337/256; 337/255; 337/264

[58] Field of Search ..... 439/621, 622; 337/255, 337/264, 295, 198, 260, 256

[56] References Cited

U.S. PATENT DOCUMENTS

| | | | |
|---|---|---|---|
| 3,909,767 | 9/1975 | Williamson et al. | 337/264 |
| 3,962,782 | 6/1976 | Williamson et al. | 29/417 |
| 4,040,175 | 8/1977 | Williamson et al. | 29/417 |
| 4,056,884 | 11/1977 | Williamson et al. | 29/417 |
| 4,827,238 | 5/1989 | Kozel | 337/255 |
| 4,884,050 | 11/1989 | Kozel | 337/621 |
| 5,324,214 | 6/1994 | De Castro | 439/621 |
| 5,346,411 | 9/1994 | Nikkiner | 439/621 |

*Primary Examiner*—Gary F. Paumen
*Attorney, Agent, or Firm*—Mirek A. Waraksa

[57] ABSTRACT

A plug-in fuse device can be handled without special tools and permits convenient replacement of a burnt-out fuse element. The device has a rigid housing with a pair of plug portions. Each plug portion is shaped to plug into a socket and carries a fuse assembly which includes a pair of terminals for engagement with socket elements, a fuse element between the terminals, and a pair of conductive contacts. The terminals extend from one end surface of the plug portion, and the contacts are located at an axially opposite end surface. The plug portions are connected at their contact-bearing surfaces, and the terminals of one plug portion extend in one axial direction and the terminals of the other plug portion, in the opposite axial direction. The plug portions are also offset to different sides of the general plane of the housing. Thus, when either plug portion is plugged into the socket, its contact-bearing surface is available for continuity testing. The device can be removed from the socket by gripping the plug portion currently external to the socket.

3 Claims, 2 Drawing Sheets

PLUG-IN FUSE DEVICE WITH INTERCHANGEABLE FUSE ELEMENTS

FIELD OF THE INVENTION

The invention relates generally to plug-in fuses, and more specifically, to interchanging fuses in a socket.

BACKGROUND OF THE INVENTION

Miniature plug-in fuses are well known in the automotive industry. Such fuses commonly have a fuse assembly formed as a unitary metal stamping. The fuse assembly comprises a pair of parallel, blade-like terminals and a fuse element that extends between the terminals. (The term "fuse element" is used in this specification to identify the component of a fuse which actually overhears and opens in response to an overload current). A plastic housing is molded about the fuse assembly with the terminals extending from the housing. The housing plugs into a complementary socket adapted to retain the housing and electrically engage the terminals. Once plugged in, only one face of the housing is exposed and the fuse element cannot be visually checked for continuity even if the housing is formed of transparent plastic. Conductive contacts are thus provided at the exposed housing face to a conventional continuity checker to be used. Such fuses and methods of manufacturing them are described in U.S. Pat. Nos. 3,909,767; 3,962,782; 4,040,175 and 4,056,884, all to Avinash and Williamson.

Such fuses are difficult to replace when burnt out. A special tool is normally used to grip and remove the fuse. An automobile user will not normally have such a tool. Also, he may not have a replacement fuse conveniently available. Although a mechanic using a continuity checker may be able to quickly isolate a defective fuse among multiple fuses, an automobile user is unlikely to have such a device and may have difficulty determining which fuse is most likely defective. In its various aspects, the present invention plug-in fuse devices that eliminate such problems.

BRIEF SUMMARY OF THE INVENTION

In one aspect, the invention provides a plug-in fuse device permitting interchangement of fuse elements within a socket. The device comprises a rigid elongate housing with an axis, a pair of axially opposing ends, and a pair of plug portions substantially parallel to the axis and each shaped for insertion and retention within the socket. One housing end faces in one axial direction and the other housing end faces in the opposite axial direction. The device also includes a pair of fuse assemblies each associated with a different plug portion. Each fuse assembly comprising a pair of terminals mounted in the associated plug portion and a fuse element electrically connected between the pair of terminals. The terminals of one assembly extend in the one axial direction from the one housing end, and the terminals of the other of the fuse assemblies extend in the opposite axial direction front the other housing end.

Such a fuse device has several advantages. It can be removed from the socket by manually gripping the plug portion that is not currently plugged into the socket. No special tool is required. If a fuse element is burnt out, the plug portions can be interchanged to replace the defective fuse element. A replacement fuse need not be found immediately. Multiple fuse devices can be tested to identify a defective fuse element by successively interchanging the fuse elements of each device and observing the operation of the circuit coupled to the fuse device (assuming that the circuit does not contain a short which will immediately blow the fuse element). The circuit can be operated and the entire fuse device so identified can be replaced when convenient.

In another aspect, the invention provides a plug-in fuse device permitting interchangement of fuse elements relative to a socket and continuity testing of a fuse element installed in the socket. The device includes a rigid housing formed with a pair of plug portions shaped for plugging into the socket. The plug portions are fixed to one another in a predetermined orientation that permits their interchangement relative to the socket. (Such interchangement for purposes of this specification means withdrawal of one plug portion and insertion of the other.) The device includes a pair of fuse assemblies each associated with a different one of the plug portions. Each fuse assembly comprises a pair of terminals that extend from the associated plug portion for operative engagement with the socket, a fuse element electrically connected between the terminals, and a pair of conductive contacts that permit continuity checking of the fuse element. Each pair of conductive contacts is so positioned on the exterior of the housing as to be accessible whenever the associated plug portion is plugged into the socket. Each plug portion preferably has a pair of opposing end surfaces, one end surface at which the contacts of the associated fuse assembly are located and another from which the terminals of the associated fuse assembly extend. One pair of terminals extends in one axial direction and the other pair, in the opposite axial direction. The plug portions are preferably offset to different sides of the general plane of the housing to ensure that the contact-bearing end surface of the plug portion inserted into the socket is accessible for continuity checking regardless which plug portion is inserted. The term "general plane" for purposes of this specification should be understood as a plane which divides the housing into substantially equal pans. Such a fuse device has not only the advantage noted above but also allows a mechanic to test the continuity of multiple fuses devices with a conventional continuity checker to quickly isolate a defective fuse.

Other aspects of the invention will be apparent from a description below of a preferred embodiment and will be more specifically defined in the appended claims.

DESCRIPTION OF THE DRAWINGS

The invention will be better understood with reference to drawings in which.

DESCRIPTION OF PREFERRED EMBODIMENTS

Figure 1:
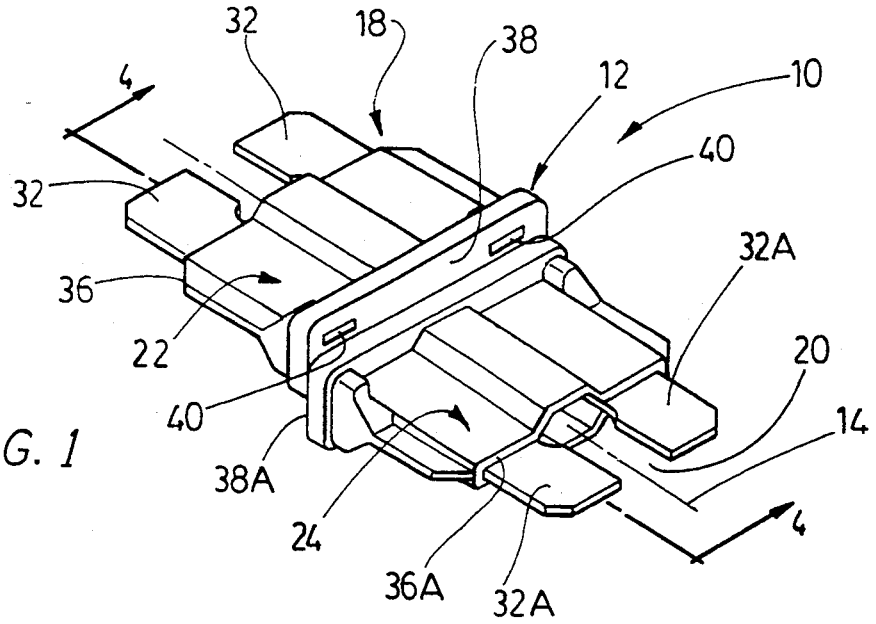
FIG. 1 is a perspective view of a fuse device embodying the invention.
Figure 2:
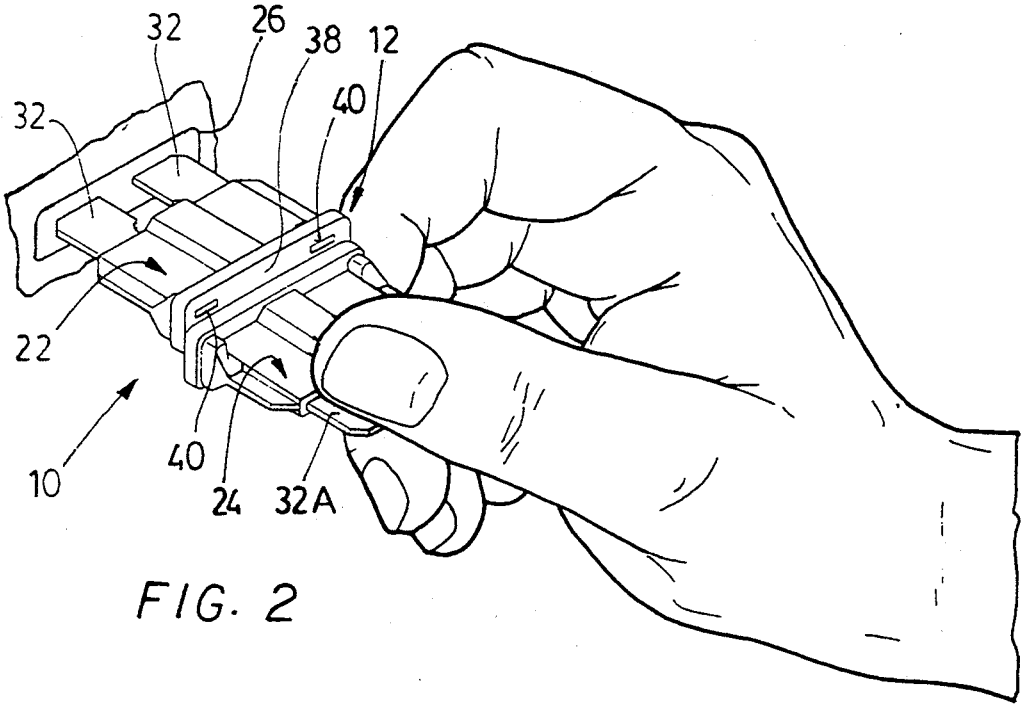
FIG. 2 is a perspective view showing how the fuse device can be handled for either insertion or removal from a complementary socket.
Figure 3:
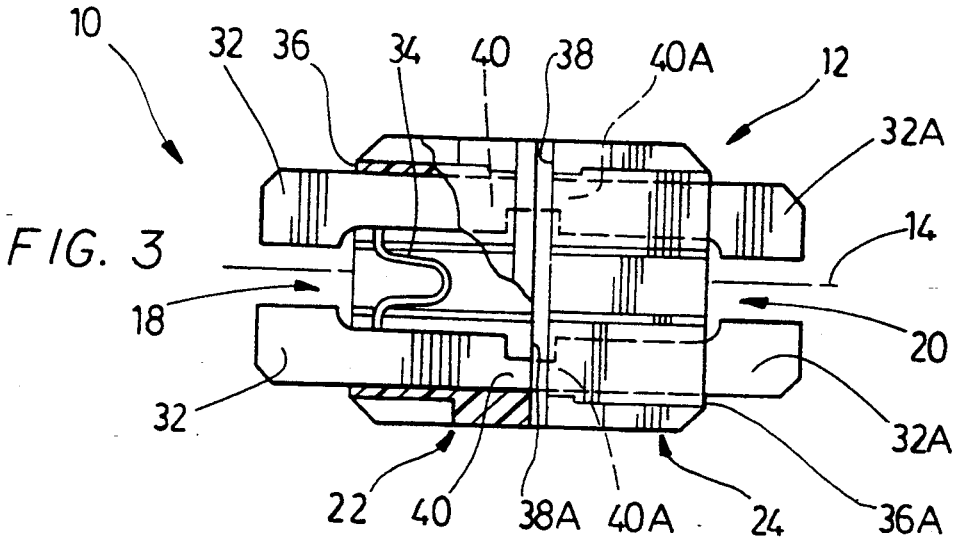
FIG. 3 is a partially fragmented plan view further detailing the construction of the fuse device.
Figure 4:
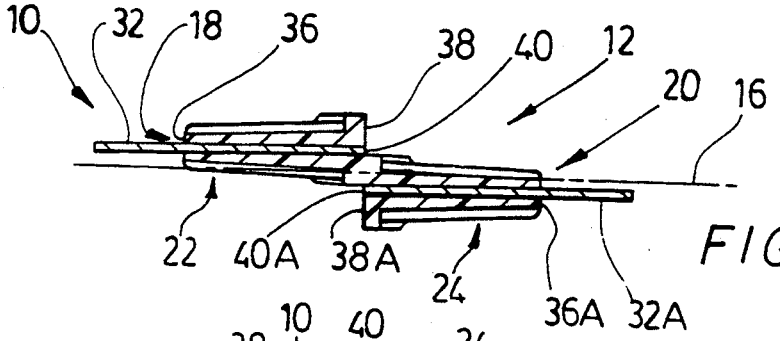
FIG. 4 is a view along lines 4—4 of FIG. 1 further indicating the geometry of the fuse device; and, FIG. 5 is a view showing how a continuity checker may be used to determine whether a fuse element is operative.

The drawings illustrate a fuse device 10 embodying the invention. The fuse device 10 comprises a rigid plastic housing 12 which has a lengthwise axis 14 (indicated in FIGS. 1 and 3), a general plane 16 (indicated in FIG. 4) containing the axis 14, and a pair of axially opposing ends 18, 20. The housing 12 comprises a pair of identical plug portions 22, 24. The plug portions 22, 24 are shaped for insertion and retention in a conventional socket 26 (shown in FIGS. 2 and 4). The device 10 also includes a pair of identical fuse assemblies 28, 30 each associated with a different one of the plug portions 22, 24.

The plug portion 22 and associated fuse assemblies 28 are typical. The fuse assemblies 28 is a metal stamping conaprising a pair of substantially parallel, blade-like terminals 32 and a fuse element 34 electrically connected between the two terminals 32. The plug portion 22 has a pair of axially opposing end surfaces 36, 38 which face in opposite axial directions. The plug portion 22 is molded about the fuse assemblies 28 with the terminals 32 extending from one end surface 36. A pair of conductive contacts 40 at the other end surface 38 of the plug portion 22 permit continuity testing. The contacts 40 are defined by end surfaces of the terminals 32 themselves so no separate and distinct means are required to separately connected each of the contacts 40 to a different one of the terminals 32. The plug portion 24 and fuse assembly 30 have components identical to those of the plug portion 22 and fuse assembly 28, which components are identified herein with the same reference numbers followed by the letter "A". (The fuse element associated with the fuse assembly 30 has not, however, been illustrated)

Figure 5:
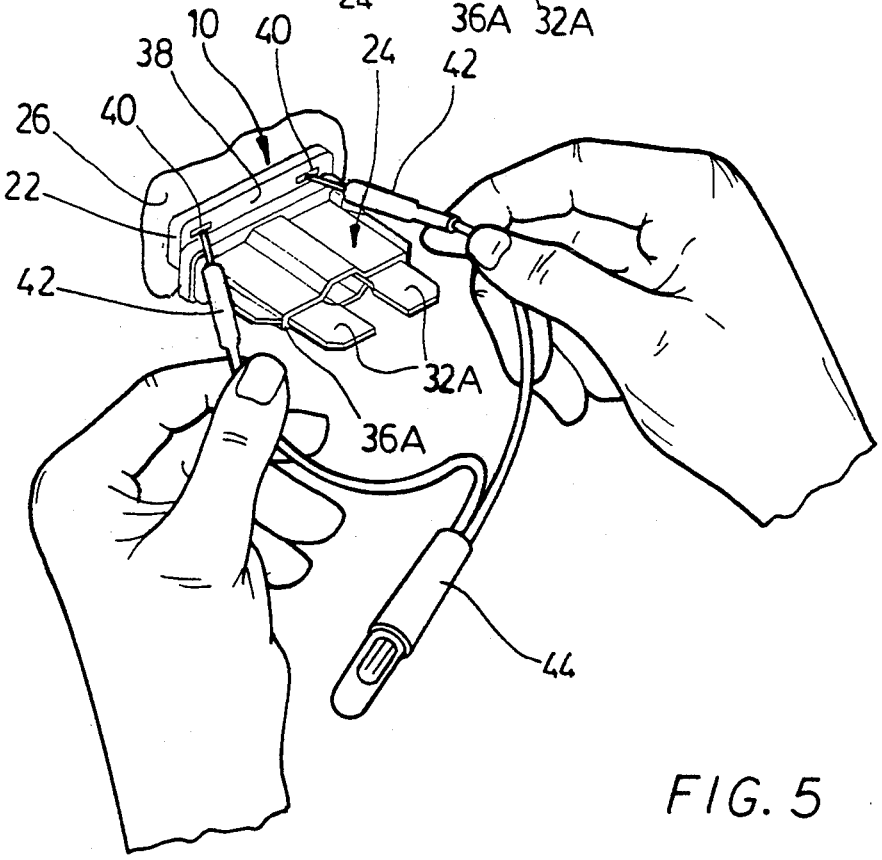

The orientation of the two plug portions 22, 24 should be noted. The plug portions 22, 24 are substantially parallel to the lengthwise axis 14. Each is offset to a different side of the general plane 16 of the housing 12 (as apparent in FIG. 4). Each of the plug end surfaces 36, 36A from which terminals protrude is at a different end 18 or 20 of the housing 12, and the particular plug end surfaces 36, 36A face in opposite axial directions. The terminals 32 extend from the housing 12 in one axial direction and the terminals 32A extend from the housing 12 in an opposite axial direction. The contact-bearing end surfaces 38, 38A of the two plug portions 22, 24 face in opposite axial directions and are located intermediate of the housing ends 18, 20. In this embodiment, an adhesive was applied to the contact-bearing surfaces, which were then overlaid. The relative orientation avoids interference between the plug portions 22, 24 when one is inserted into the socket 26. It also ensures that the contacts 40 or 40A mounted to the plug portion 22 or 24 which is currently plugged into the socket 26 are accessible externally of the socket 26 (without interference from the other plug portion) for continuity checking. This is most apparent in FIG. 5, where the plug portion 22 is currently plugged into the socket 26. Its contact-bearing end surface 38 protrudes partially from the socket 26. Its contacts 40 are immediately accessible for engagement with probes 42 of a continuity checker 44. The other plug portion 24, which is then completely outside the socket 26, is offset downwardly and does not interfere with application of the probes 42.

The fuse device 10 can be handled without a special tool. As will apparent from FIG. 2, the device 10 can be handled by means of the plug portion 24 either to install or remove the other plug portion 22. To interchange the plug portions 22, 24, the device 10 need only be flipped end-for-end. The plug portion 24 can then be installed by gripping the other plug portion 22.

Various modifications may be made. The two plug portions 22, 24 were adhesively bonded for convenience of producing a sample device. They may instead be molded together about their respective fuse assemblies 28, 30 by appropriately modifying the manufacturing procedures described in the earlier U.S. patents to Avinash and Williamson, whose teachings are incorporated herein by reference. The two plug portions 22, 24 need not be connected directly at their contact-bearing end surfaces 38, 38A. They may instead by joined by a thin bridging portion which further spaces the plug portions 22, 24 axially or vertically or both. The parallel, axial orientation of the two plug portions 22, 24 is preferred to avoid potential interference with similar fuse devices in a common fuse box. Such multiple fuse devices are most likely to be mounted in sockets that are oriented in a common plane.

It will be appreciated that a particular embodiment of the invention and possible modifications thereto have been described and that further modifications may be made without departing from the spirit of the invention or necessarily departing from the scope of the appended claims.

We claim:

1. A plug-in fuse device permitting testing and interchangement of fuse elements within a socket, comprising:

a housing with an exterior, the housing comprising a pair of plug portions, each of the plug portions being shaped for plugging into the socket, the plug portions being fixed to one another in an orientation that permits interchangement of the plug portions relative to the socket; and, a pair of fuse assemblies, each of the fuse assemblies being associated with a different one of the plug portions, each of the fuse assemblies comprising:

(a) a pair of terminals mounted to and extending from the associated plug portion such that the pair of terminals are operatively engaged by the socket when the plug portion associated with the fuse assembly is plugged into the socket;

(b) a fuse element electrically connected between the pair of terminals, and, (c) a pair of conductive contacts each electrically connected to a different one of the terminals and positioned on the exterior of the housing such that the contacts are accessible externally of the socket when the plug portion associated with the fuse assembly is plugged into the socket.

2. A fuse device as claimed in claim 1 in which:

the housing has a general plane;

each of the plug portions has one end surface at which the contacts of the fuse assembly associated with the plug portion are located and an opposing end surface from which the terminals of the fuse assembly associated with the plug portion extend; and, each of the plug portions is offset to a different side of the general plane such that its one end surface is accessible from externally of the socket when the plug portion is plugged into the socket.

3. A plug-in fuse device permitting testing and interchangement of fuse elements relative to a socket, comprising:

a rigid elongate housing comprising a general plane, an axis within the general plane, a pair of axially opposing ends, and a pair of plug portions oriented substantially parallel to the axis, each of the plug portions being shaped for insertion into and retention within the socket;

each of the plug portions comprising a pair of axially opposing end surfaces facing in opposite axial directions, one of the end surfaces of one of the plug portions being located at one of the axial ends of the housing and one of the end surfaces of the other of the plug portions being located at the other of the axial ends of the housing, the one end surface of the one plug portion facing in one axial direction and the one end surface of the other plug portion facing in the opposite axial direction, the other end surface of each of the plug portions being located intermediate of the opposing ends of the housing;

a pair of fuse assemblies, each of the fuse assemblies being associated with a different one of the plug portions, each of the fuse assemblies comprising:

(a) a pair of terminals mounted within the plug portion associated with the fuse assembly and extending externally from the one end surface of the plug portion associated with the fuse assembly;

(b) a fuse element electrically connected between the pair of terminals, and, (c) a pair of conductive contacts, each of the contacts being electrically connected to a different one of the terminals and being located at the other end surface of the plug portion associated with the fuse assembly;

the terminals of the fuse assembly associated with the one plug portion extending in the one axial direction and the terminals of the fuse assembly associated with the other plug portion extending in the opposite axial direction;

each of the plug portions being offset to a different side of the general plane such that the contacts in its other end surface are accessible from externally of the socket whenever the plug portion is inserted into the socket.

* * * * *